US005528208A

United States Patent [19]

Kobayashi

[11] Patent Number: 5,528,208

[45] Date of Patent: Jun. 18, 1996

[54] FLEXIBLE WAVEGUIDE TUBE HAVING A DIELECTRIC BODY THEREON

[75] Inventor: Hideki Kobayashi, Tokyo, Japan

[73] Assignee: NEC Corporation, Japan

[21] Appl. No.: 241,134

[22] Filed: May 10, 1994

[30] Foreign Application Priority Data

May 12, 1993 [JP] Japan ..... 5-133937

[51] Int. Cl.[6] ..... H01P 3/14

[52] U.S. Cl. ..... 333/241; 333/248

[58] Field of Search ..... 333/241, 239, 333/248

[56] References Cited

U.S. PATENT DOCUMENTS

| | | | |
|---|---|---|---|
| 2,433,368 | 12/1947 | Johnson et al. | 333/239 X |
| 2,897,461 | 7/1959 | Asbaugh et al. | 333/239 |
| 3,028,565 | 4/1962 | Walker et al. | 333/239 X |
| 3,659,234 | 4/1972 | Schuttloffel et al. | 333/241 |
| 3,974,467 | 8/1976 | Tobita et al. | 333/241 |

FOREIGN PATENT DOCUMENTS 60-180302 9/1985 Japan .

*Primary Examiner*—Benny T. Lee
*Attorney, Agent, or Firm*—Ostrolenk, Faber, Gerb & Soffen

[57] ABSTRACT

A flexible waveguide tube is applicable for a desired millimeter wave band with maintaining sufficient strength for satellite application. The flexible waveguide tube includes a bellows portion and flexing at the bellows portion. The flexible waveguide tube further comprises a dielectric body disposed within the waveguide tube, the dielectric body being placed in spaced apart relationship with at least one inner peripheral surface of the bellows portion.

14 Claims, 13 Drawing Sheets

FLEXIBLE WAVEGUIDE TUBE HAVING A DIELECTRIC BODY THEREON

BACKGROUND OF THE INVENTION

The present invention relates a flexible waveguide tube. Specifically, the invention relates to a flexible waveguide tube for connection of a waveguide circuit having sufficient strength to be used for connection between on-board equipment in a satellite.

In general, the dimensions of a rectangular waveguide tube for a millimeter wave band are quite small, such as 5.7 mm in its longitudinal dimension and 2.85 mm in its transverse dimension at the 40 GHz band. Therefore, it is quite difficult to produce a flexible waveguide tube with a sufficient strength for such wave band. In particular, in case of the waveguide tube connection circuit to be mounted on a satellite, it is required to have sufficient strength for withstanding the severe vibrations that accompany the launching of the satellite. Therefore, such flexible waveguide tube is required to withstand severe vibrations of 19.6 grms. The rectangular waveguide tube produced to provide the flexible waveguide tube with a sufficient strength is 7.1 mm in longitudinal dimension and 3.5 mm in its transverse dimension. This limits the frequency band that may be used to between 26.5 to 40 GHz.

FIG. 11 shows an external appearance of the conventional flexible waveguide in an assembled condition. Also a cross-sectional view of the flexible waveguide along the center line of the longer diameter is shown in FIG. 12.

As shown in FIG. 11, the conventional flexible waveguide tube includes rectangular tube portions 2 at both ends of a bellows portion 1. Flanges 5 are further provided for connection with other waveguide tubes, which are not shown. Since the bellows portion 1 is provided, the waveguide can be bent in a direction shown by an arrow Y1 in FIG. 11. The flexible waveguide tube can also be bent in the direction Y2, also shown in FIG. 11. It should be noted that the reference numeral 6 denotes a mounting holes.

With reference to FIG. 12, the cross-section of the walls of bellows portion 1 are wavy in configuration, and this wavy configuration has an amplitude H of 0.5 mm.

Since the excessive amplitude of the wavy wall could influence the characteristics of the waveguide, the amplitude H should be as small as possible. However, in view of the current technology in processing, it is difficult to make the amplitude smaller than approximately 0.5 mm.

The assembled flexible waveguide tube was evaluated relative to transmission loss versus frequency. The results of this evaluation is shown in FIG. 13. In FIG. 13, the transmission loss was 1.5 dB and a transmission loss difference (difference between a peak value and a minimum value) in the 200 MHz band width was 1.3 dB. However, this performance cannot satisfy a required performance of less than or equal to 0.5 dB in the transmission loss and 0.2 dB in transmission loss difference.

The above-mentioned conventional flexible waveguide tube has large transmission losses and the transmission loss difference in the millimeter wave band is higher than or equal to 40 GHz, and thus it cannot be used as the waveguide connection circuit installed in a satellite.

On the other hand, Japanese Unexamined Patent Publication No. 60-180302 discloses a tapered waveguide tube for connecting two circular waveguide tubes having mutually different diameters. The principle of the above-identified prior art is as follows. Since the waveguide tubes having mutually different diameters, they cannot be directly connected because of differences in impedances. Therefore, in order to match the impedances, connection is established by means of the tapered waveguide tube, and the interior of the waveguide tube is filled with a bar-shaped dielectric body.

Such construction is effective in connection of the waveguides having mutually different diameters with matching of the impedances. However, since it takes the construction completely filled with the bar-shaped dielectric body, it cannot provide flexibility when the above-mentioned construction is employed as the flexible waveguide tube.

SUMMARY OF THE INVENTION

With taking the above-mentioned problems in the prior art in mind, it is an object of the present invention to provide a flexible waveguide which can be used for a predetermined millimeter wave band with maintaining sufficient strength for satellite application.

In order to accomplish the above-mentioned object, a flexible waveguide tube, according to the present invention, including a bellows portion and flexing at the bellows portion, comprises at least one dielectric body disposed within the waveguide tube, with the dielectric body being placed in spaced apart relationship with at least one inner peripheral surface of the bellows portion.

BRIEF DESCRIPTION OF THE DRAWINGS

The present invention will be more fully understood from the detailed description given herebelow and from the accompanying drawings of the preferred embodiments of the invention, which, however, should not be taken to be limitative to the invention, but are for explanation and understanding only.

In the drawings.

DESCRIPTION OF THE PREFERRED EMBODIMENT

The present invention will be discussed in detail in terms of preferred embodiments of the present invention with reference to the accompanying drawings, in which identically labelled elements are identical to each other and each such element may not be described in connection with all figures in which the element appears. In the following description, numerous specific details are set forth in order to provide a thorough understanding of the present invention. It will be obvious, however, to those skilled in the art that the present invention may be practiced without these specific details. In other instances, well-known structures are not shown in detail in order not to unnecessary obscure the present invention.

Figure 1:
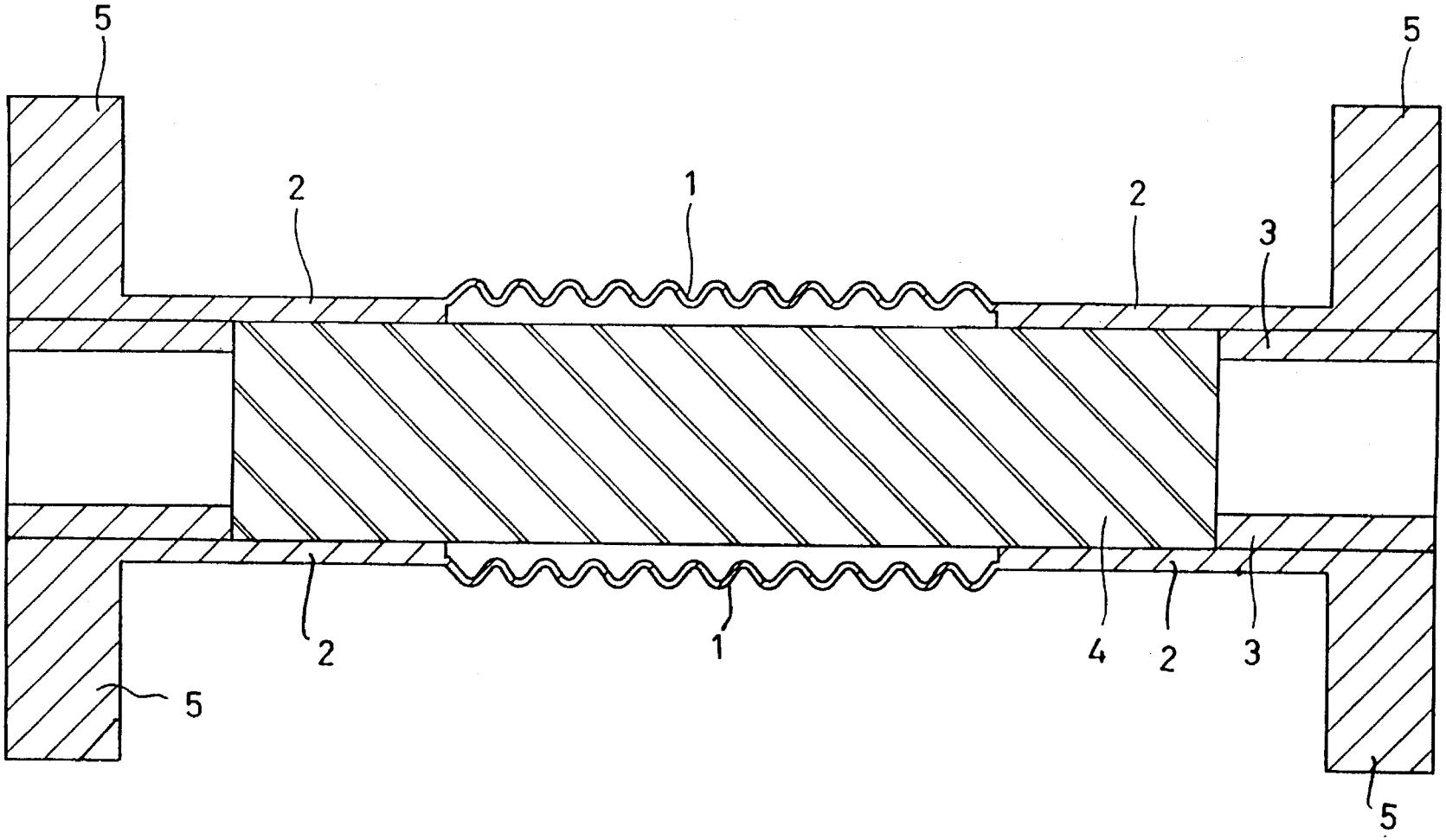
FIG. 1 is a cross-sectional view showing an internal structure of the preferred embodiment of a flexible waveguide tube according to the present invention.
Figure 2:
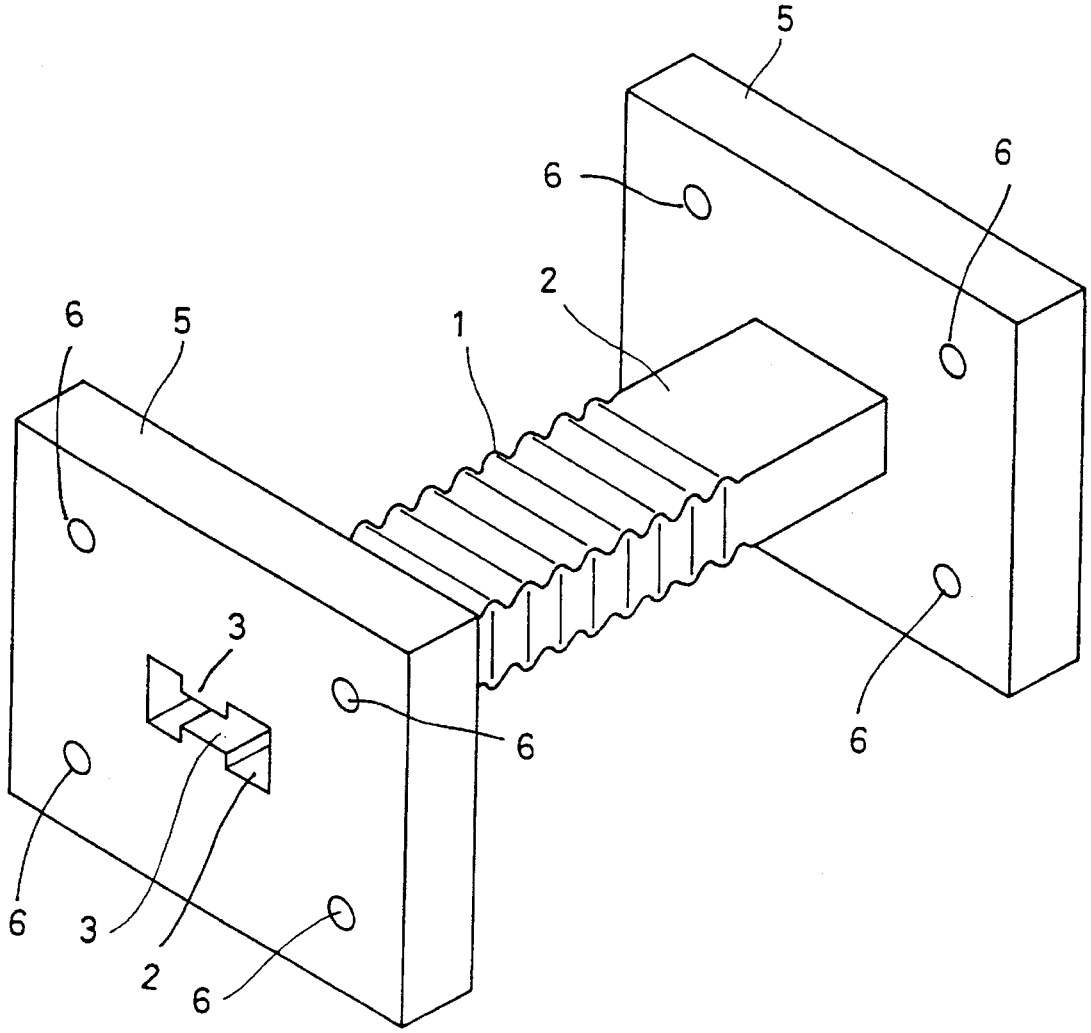
FIG. 2 is an perspective view showing the construction of the preferred embodiment of the flexible waveguide tube according to the invention.
Figure 11:
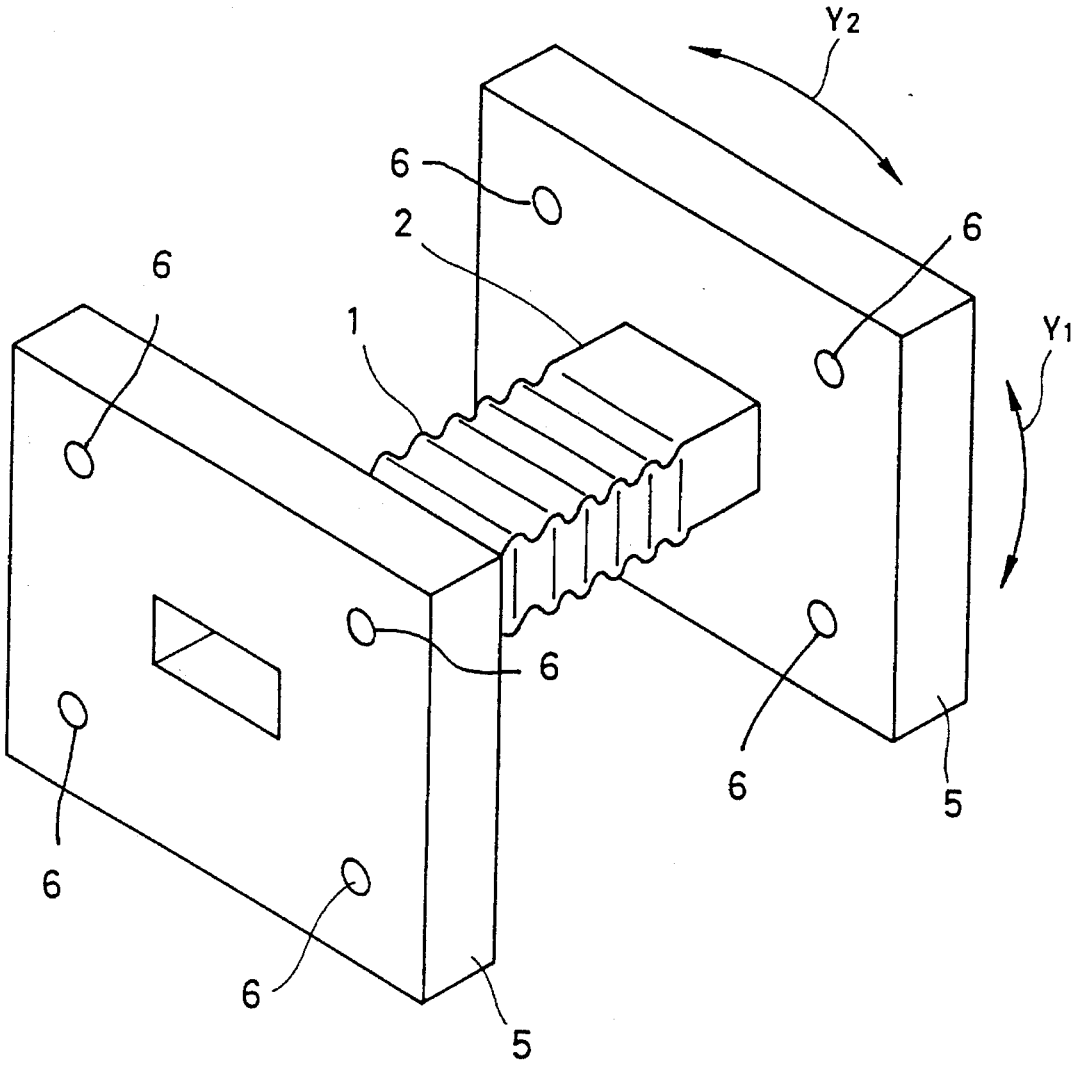
FIG. 11 PRIOR ART
FIG. 11 is an external view showing the construction of a conventional flexible waveguide tube.
Figure 12:
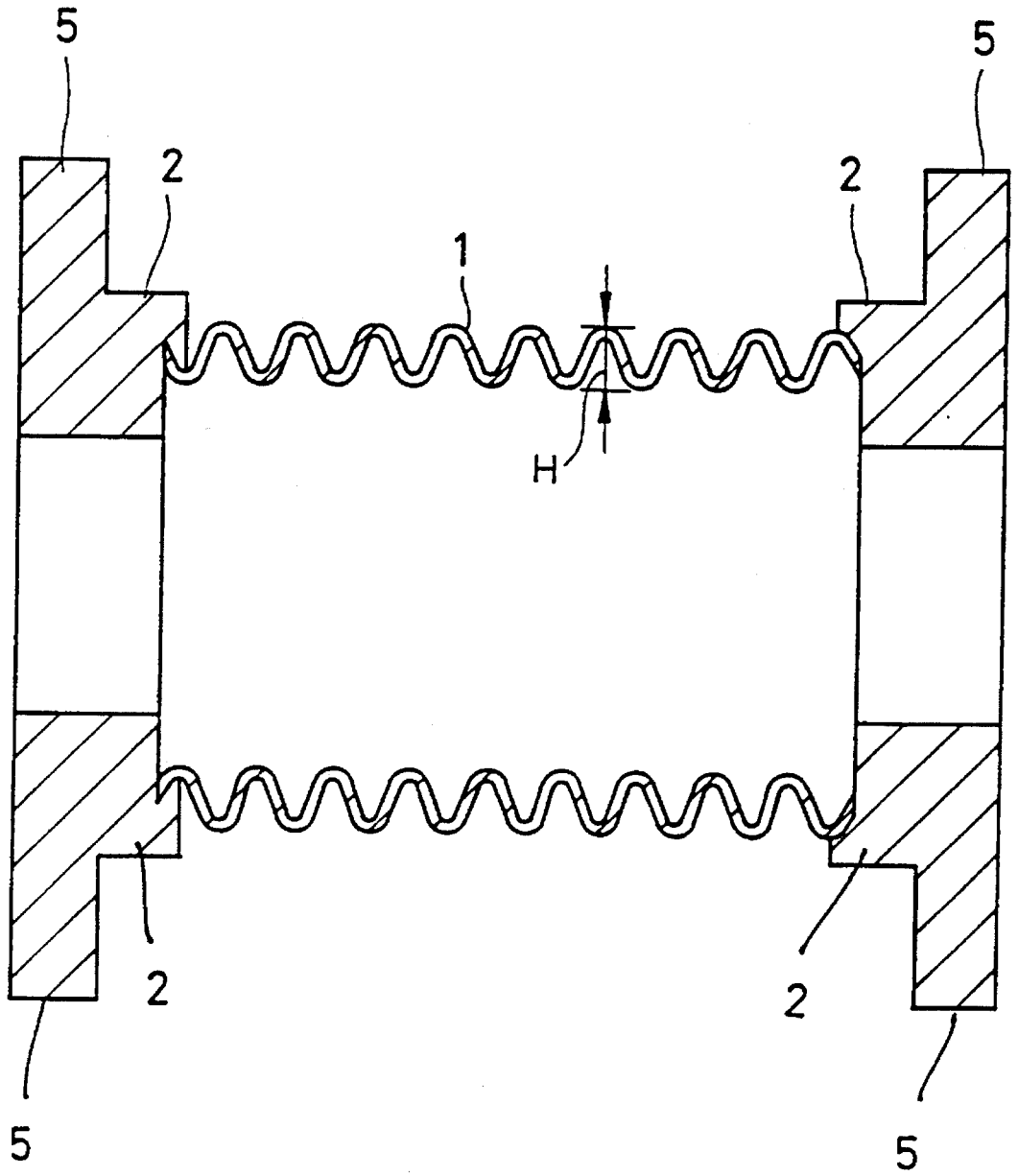
FIG.12 PRIOR ART
FIG. 12 is a cross-sectional view showing the internal construction of the conventional flexible waveguide tube of FIG. 11.

FIG. 2 shows an external perspective view of one embodiment of the flexible waveguide tube according to the present invention. In FIG. 2, like components to FIG. 11 will be represented by like reference numerals. Also, FIG. 1 is a cross-sectional view along the center line in the longitudinal dimension (i.e., the longitudinal axis) of the flexible waveguide tube of FIG. 2.

Figure 3:
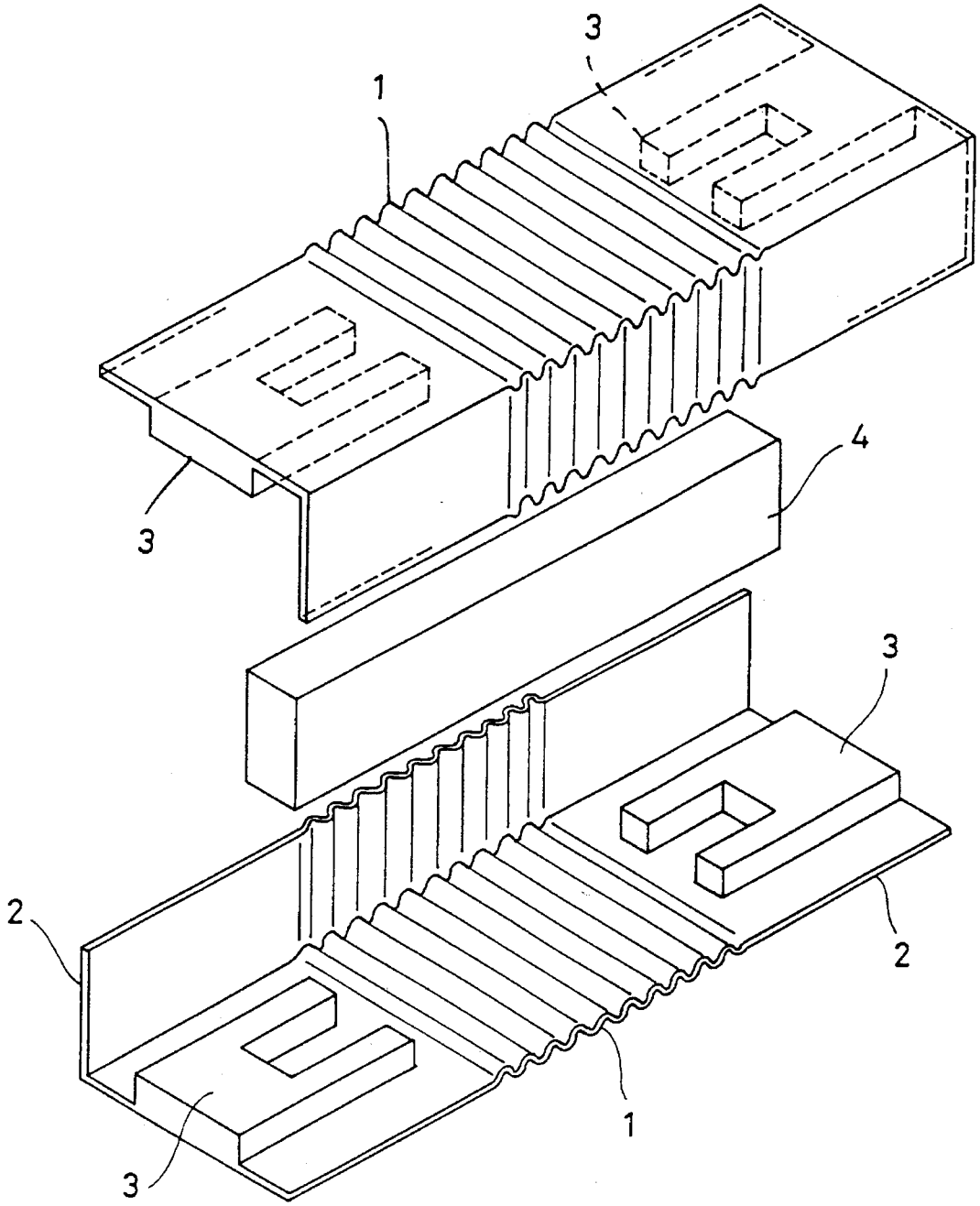
FIG. 3 is an exploded view showing the internal construction of the preferred embodiment of the flexible waveguide tube according to the invention.

As shown in FIG. 1, the shown embodiment of the flexible waveguide tube comprises a bellows portion 1, rectangular tube portions 2 provided at both ends of the bellows portion 1, and flanges 5 formed integrally with the rectangular tube portions 2. The shown embodiment of the flexible waveguide tube is provided with a dielectric body 4 in spaced apart relationship with the peripheral wall of the bellows portion 1. By the presence of the dielectric body 4, the characteristics of the waveguide can be improved. FIG. 3 is an exploded view of the flexible waveguide tube of FIGS. 1 and 2. In FIG. 3, the flexible waveguide tube is constructed by connecting the rectangular tube portions 2 to both ends of the bellows portion 1. The flanges 5 of FIGS. 1 and 2 are not shown in FIG. 3. Within the flexible waveguide tube constructed as set forth above, the dielectric body 4 is received in recessed portions of four dielectric body supports 3 and thus supported in the interior space of the flexible waveguide tube in spaced apart from the inner periphery of the bellows portion 1.

As can be appreciated, since the shown embodiment of the flexible waveguide tube incorporates the dielectric body 4 which has low transmission loss, it becomes possible to use the flexible waveguide tube at frequencies higher than or equal to 40 GHz, while maintaining sufficient strength for satellite application. Also, the dielectric body 4 is supported by the dielectric body supports 3 provided on the rectangular tube portions 2 which are connected to front and rear ends of the bellows portion 1 of the flexible waveguide, and thus is positioned substantially at the center in the longer diameter. In this condition, clearance defined between respective four peripheral walls of the bellows portion 1 and the outer periphery of the dielectric body, provides satisfactory flexibility for the bellows portion 1.

As a material for forming the dielectric body, a material having low transmission loss at the millimeter wave band and having some degree of flexibility, such as poly tetra fluoro ethylene (PTFE) may be used. Materials which have further higher specific dielectric constant, such as ceramics, ferrite and so forth can also be used. However, excessively high specific dielectric constant may cause significant variation of the impedance, it is preferred to use the materials having the specific dielectric constant in an order of 2 to 10.

Figure 4:
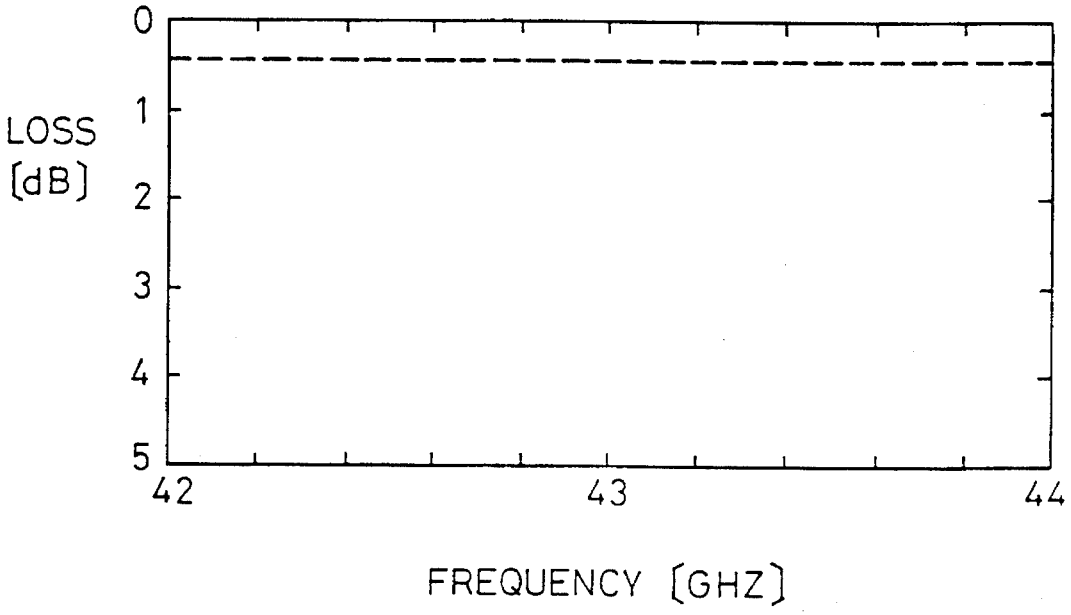
FIG. 4 is a chart showing the frequency characteristics of the preferred embodiment of the flexible waveguide tube according to the invention.
Figure 13:
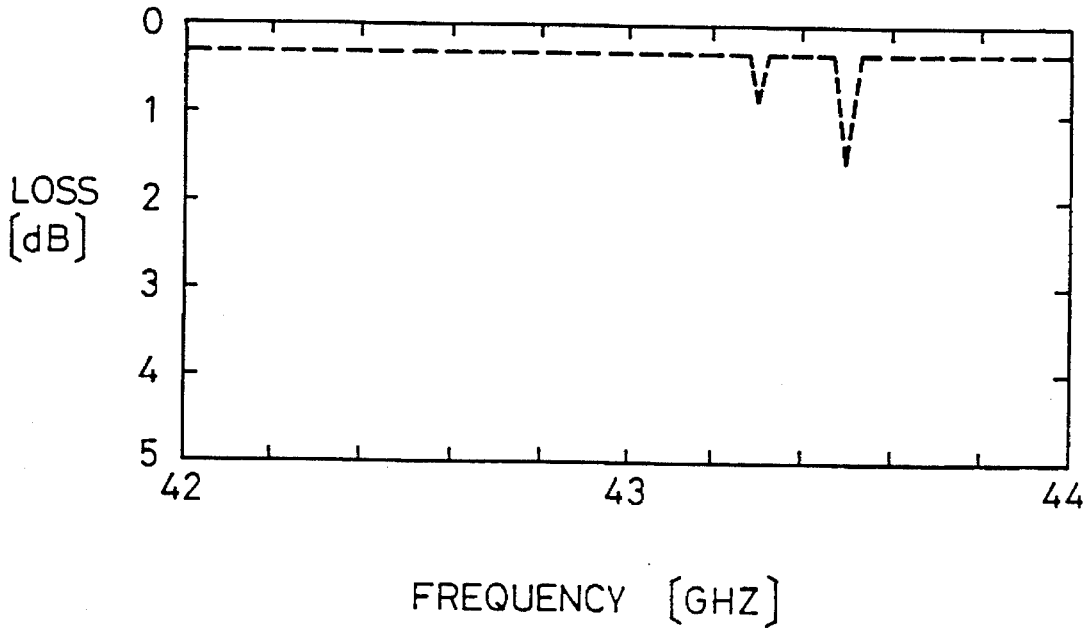
FIG.13 PRIOR ART
FIG. 13 is a chart showing the frequency characteristics of the conventional waveguide tube of FIG. 11.

The transmission loss characteristics of the dielectric flexible waveguide tube constructed as set forth above is illustrated in FIG. 4. The peak of the transmission loss due to an unnecessary mode which has occurred in the conventional waveguide tube as illustrated in FIG. 13 is shifted to lower frequency in the extent of 2 GHz to appear at 41.3 GHz and 41.5 GHz, respectively, and the transmission loss is increased to be 2 dB. However, in the frequency range of 42 to 44 GHz, the transmission loss is decreased to be 0.3 dB. In this frequency range, the transmission loss difference in the 200 MHz band width is zero. From this, it is found that the shown embodiment of the flexible waveguide tube is satisfactorily applicable for the waveguide tube connection circuit for the millimeter wave band ranging 42 to 44 GHz.

This is caused by the influence of the dielectric constant of the dielectric body which causes a shift of the shut-down frequency of the waveguide tube to the lower frequency range and thus to causes a shift of a mode conversion frequency for converting from $TE_{10}$ mode to $TE_{20}$ mode to the lower frequency.

Here, the specific dielectric constant $\epsilon\gamma$ of poly tetra fluoro ethylene (PTFE) is 2. Employment of the material having a large specific dielectric constant may cause a greater magnitude of shifting of the frequency. When the size is reduced in the material having the same dielectric constant, the shifting magnitude of the frequency becomes small. The position of the dielectric body is not specified to be within the bellows portion 1 but can be provided in the rectangular tube portions 2. If necessary, it is possible to fill the rectangular tube portions 2 with the dielectric body.

The configuration of the dielectric body 4 is shown in the rectangular bar shaped configuration in the shown embodiment. However, such specific configuration should be understood as a mere example for facilitating clear understanding of the invention. For instance, the dielectric body may have a cross-sectional configuration that is circular, or rectangular, or of any other configuration that will attain a comparable effect. Also, the dielectric body support 3 may be any appropriate configuration as long as it is convenient for supporting the dielectric body. Furthermore, the configuration of the waveguide should not be limited to the shown specific configuration but can be of any appropriate configurations, such as known ridge waveguide tube.

Next, discussion will be given for the reason of variation of the characteristics of the waveguide tube by providing the dielectric body within the waveguide tube, namely the reason of shifting of the frequency range of the transmission signal.

Figure 5B:
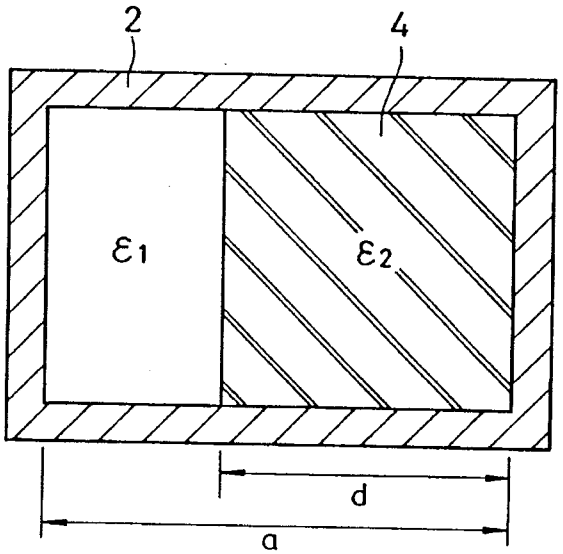
FIG. 5B is a cross-sectional view of the internal structure of the flexible waveguide tube wherein a dielectric body is placed at one side of the waveguide.
Figure 5D:
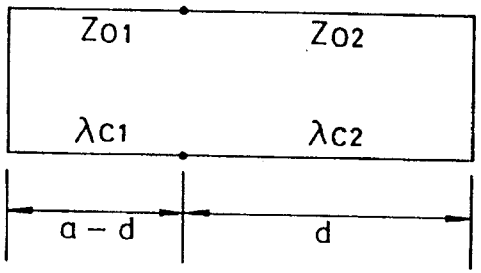
FIG. 5D is the equivalent circuit of the waveguide of FIG. 5B.
Figure 5A:
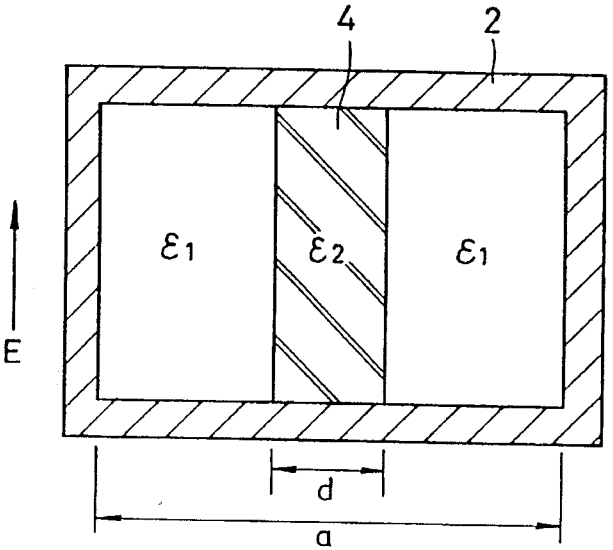
FIG. 5A is a cross-sectional view of the internal structure of the flexible waveguide tube wherein a dielectric body is located at the center of the waveguide.
Figure 5C:
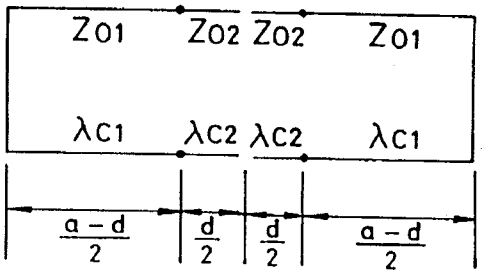
FIG. 5C is the equivalent circuit of the waveguide of FIG. 5A.

When the dielectric body having the dielectric constant $\epsilon 2$ is provided in the waveguide tube having the dielectric constant $\epsilon 1$, the cross section of the waveguide tube becomes as illustrated in FIGS. 5A or 5B. In FIGS. 5A and 5B, a denotes the internal width of the waveguide tube and d denotes a width of the dielectric body. Here, assuming the characteristic impedance by the dielectric constant $\epsilon 1$ is $Z_{01}$, and the characteristic impedance by the dielectric constant $\epsilon 2$ is $Z_{02}$, equivalent circuits are illustrated as shown in FIGS. 5C and 5D, respectively. In FIGS. 5C and 5D, $\lambda c1$ and $\lambda c2$ are wavelengths at shut-off frequency, while $Z_{01}$, $Z_{02}$, a, and d have the same meanings as described immediately above in connection with FIGS. 5A and 5B.

In FIG. 5A, the section of the waveguide tube is the rectangular configuration. The dielectric body 4 is disposed to mate with opposing two out of four internal peripheral surfaces of the rectangular tube portions 2. In the shown construction, the dielectric body 4 is positioned to contact along the center lines along a wave propagating direction (perpendicular direction to the paper surface) of the mating two peripheral surfaces.

By arranging the dielectric body 4 in such position, the frequency characteristics of the waveguide tube can be varied in the case where the wave propagating in the waveguide is a vertically polarized wave (a wave having the electric field in the direction indicated by an arrow E in the drawing).

In FIG. 5B, the dielectric body 4 is mating with three out of four internal peripheral surfaces of the rectangular tube portions 2. The dielectric body 4 is positioned to contact with the longitudinal axes of the opposing two out of three mating surfaces, extending along the wave propagating direction.

Even when the dielectric body is provided at such position, the frequency characteristics can be varied when the wave propagating in the waveguide tube is the vertically polarized wave. It should be noted that though the constructions in FIGS. 5A and 5B are adapted to the case where the wave propagating in the waveguide tube is the vertically polarized wave, it is possible to adapt the shown construction for a horizontally polarized wave by rotating the shown position in the extent of 180°.

Figure 6:
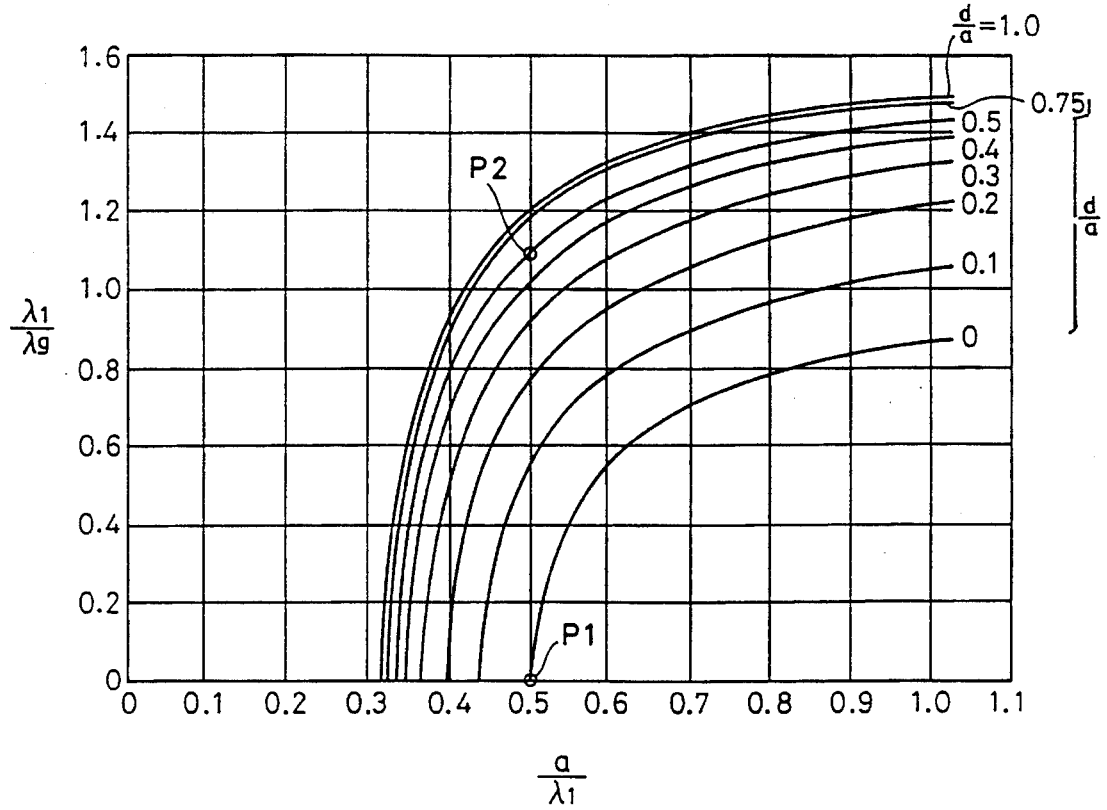
FIG. 6 is a graph showing characteristics of the waveguide tube where the dielectric body is provided as shown in FIG. 5A.
Figure 7:
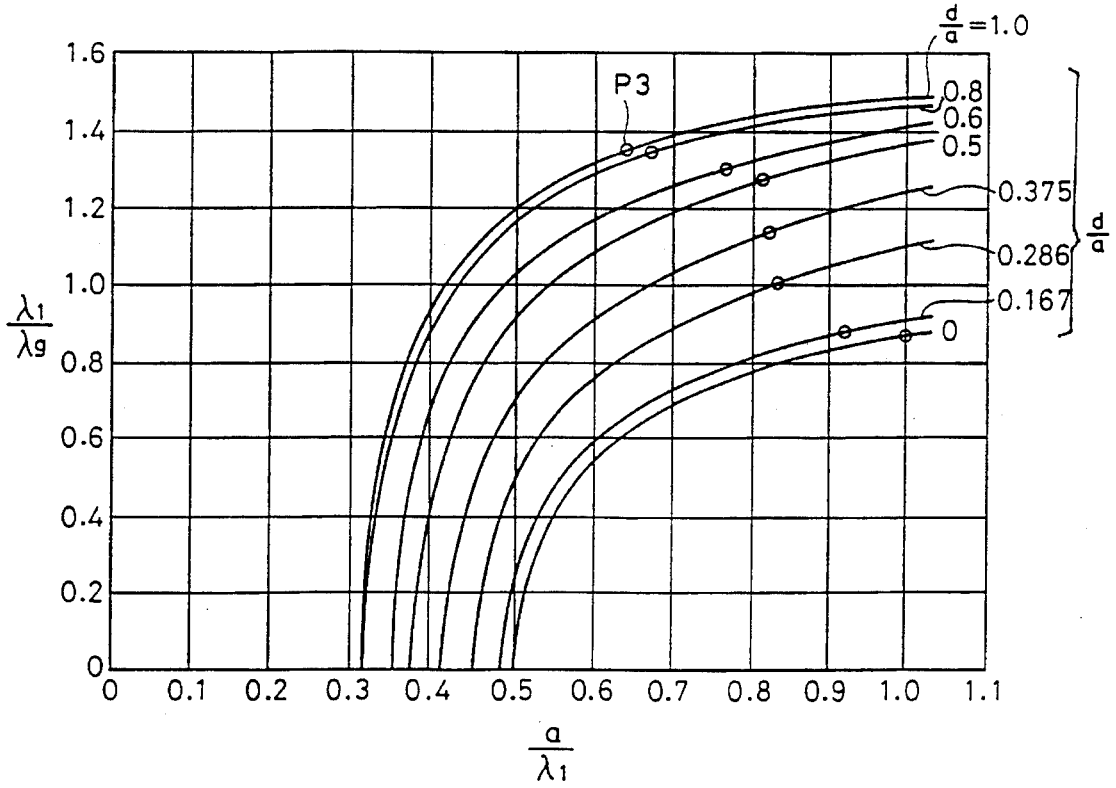
FIG. 7 is a graph showing characteristics of the waveguide tube where the dielectric body is provided as shown in FIG. 5B.

The frequency characteristics in the case where the dielectric body provided in the tube as shown in FIGS. 5A and 5B are shown in FIGS. 6 and 7. Since these figures are illustrated in terms of the wavelength, it practically has a relationship of frequency=(light velocity)/(wavelength). It should be noted that the specific dielectric constant is $\epsilon 2/\epsilon 1=2.45$ which value is close to that of poly tetra fluoro ethylene (PTFE).

Here, the shut off frequency is derived. In FIG. 6, $\lambda 1$ is the wavelength corresponding to the dielectric constant $\epsilon 1$, and the frequency in the case of $\lambda 1=2a$ is the frequency when the dielectric body is not provided. In FIG. 6, d/a=0 in the case of $a/\lambda 1=0.5$, represents the state where no dielectric body is provided, which is shown by P1. At this time, since $\lambda 1/\lambda g=0$, the wavelength $\lambda g$ in the tube becomes infinite, the frequency becomes close to the direct current so as not to propagate the wave. This is the shut-off frequency.

At the frequency in the case of $\lambda 1=2a$, $\lambda 1/\lambda g=1.1$ is established by d/a=0.5 and thus can be expressed by P2. In this case, $\lambda g=\lambda 1/1.1=2a/1.1$ is established so that the wavelength $\lambda g$ within the tube becomes smaller than $\lambda 1$ to propagate the wave.

In FIG. 7, there is illustrated the characteristics in the case where the dielectric body is positioned within the waveguide tube at the position inclining to one side, which characteristics is similar to that of FIG. 6. Here, the shut-down frequency for the $TE_{20}$ mode is shown by "0" designations. While $a/\lambda 1=1$ when d/a=0, $a/\lambda 1=0.64$ is established if d/a=1.0, which is shown by P3. At this time, $\lambda 1=a/0.64=1.56\times a$ is established. Accordingly, the shut down wavelength becomes longer to shift the shut down frequency to the lower frequency.

This relationship may be expressed as:

$$Z_{01}\tan\left(\frac{2\pi}{\lambda c1}\right)(a-d)=-Z_{02}\tan\left(\frac{2\pi}{\lambda c2}\right)d$$

Next, discussion will be given for the configuration of the dielectric body. The configuration of the dielectric body is not limited to the rectangular bar shape as illustrated in FIGS. 5A and 5B, but can be circular shaped configuration or polygon shaped configuration, such as triangular, hexagonal or so forth.

Figure 8A:
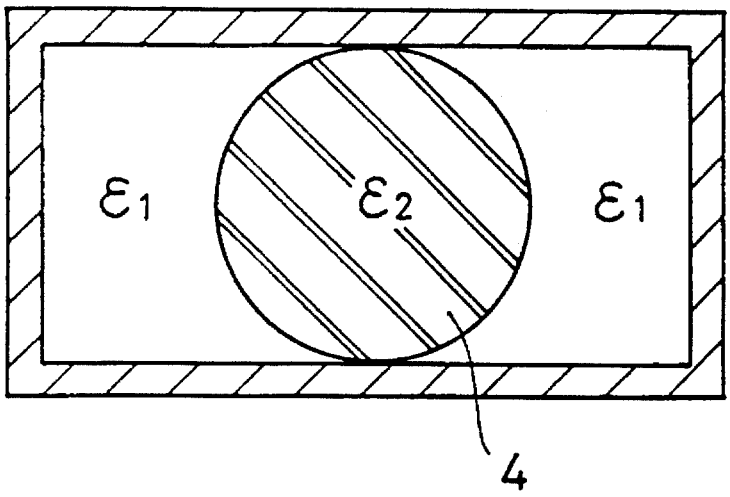
FIGS. 8A and 8B are cross-sectional views of other embodiments of the flexible waveguide tube according to the present invention.
Figure 8B:
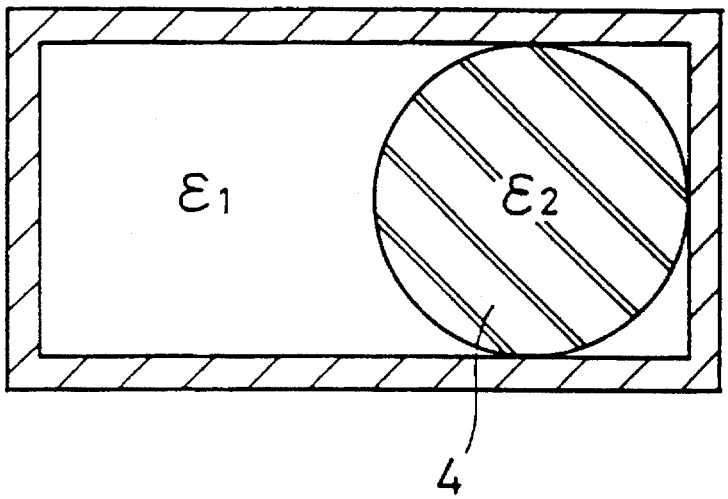

For instance, in case of the circular cross section, namely, when a cylindrical dielectric body is provided, the cross section of the waveguide tube will become as illustrated in FIGS. 8A and 8B. In case of the construction illustrated in FIG. 8A, the cylindrical dielectric body 4 is positioned to contact with only two out of four internal peripheral surfaces of the rectangular tube portions. In addition, the dielectric body is in contact along the longitudinal axes of the contacting surfaces, which longitudinal axes extend along the wave propagating direction. By this, the characteristics of the waveguide tube can be varied similarly to FIG. 5A.

When the cylindrical dielectric body 4 is positioned to contact with three out of four internal peripheral surfaces of the rectangular waveguide tube portion as shown in FIG. 8B, the characteristics of the waveguide tube can be varied.

Figure 9A:
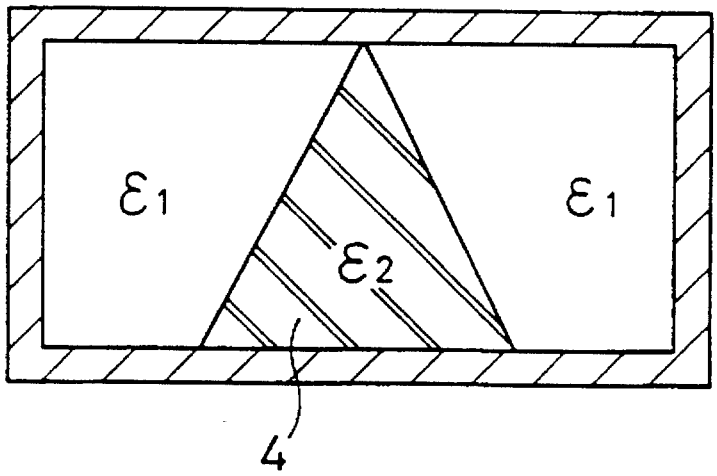
FIGS. 9A and 9B are cross-sectional views of further embodiments of the flexible waveguide tube according to the present invention.
Figure 9B:
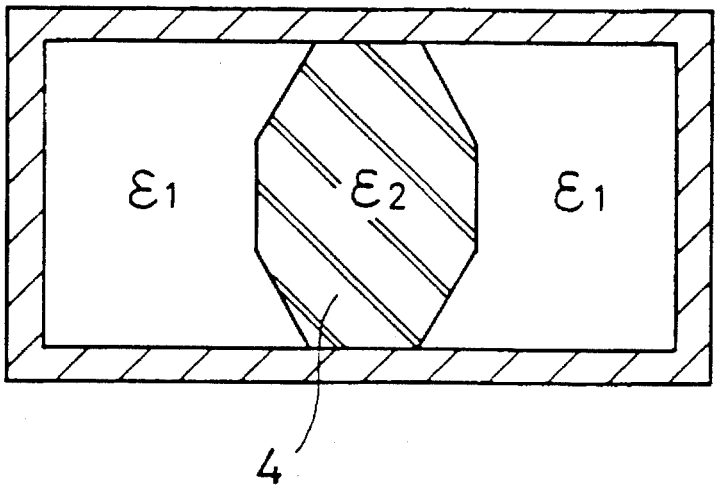

Similarly, the characteristics can be varied even when the dielectric body is formed into the triangular configuration as illustrated in FIG. 9A or into hexagonal configuration as illustrated in FIG. 9B.

Figure 10A:
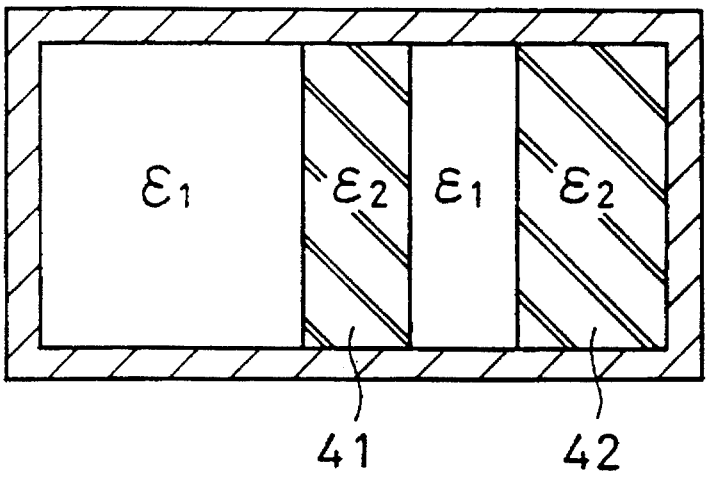
FIGS. 10A and 10B are cross-sectional views of a still further embodiments of the flexible waveguide tube according to the present invention.

Furthermore, the number of the dielectric body to be provided in the waveguide tube is not limited to one but can be plural. For instance, the characteristics can be varied by providing a dielectric body 41 which contacts opposing two out of four internal peripheral surfaces of the rectangular waveguide tube and a dielectric body 42 which contacts with three out of four internal peripheral surfaces of the rectangular waveguide tube, as shown in FIG. 10A.

Figure 10B:
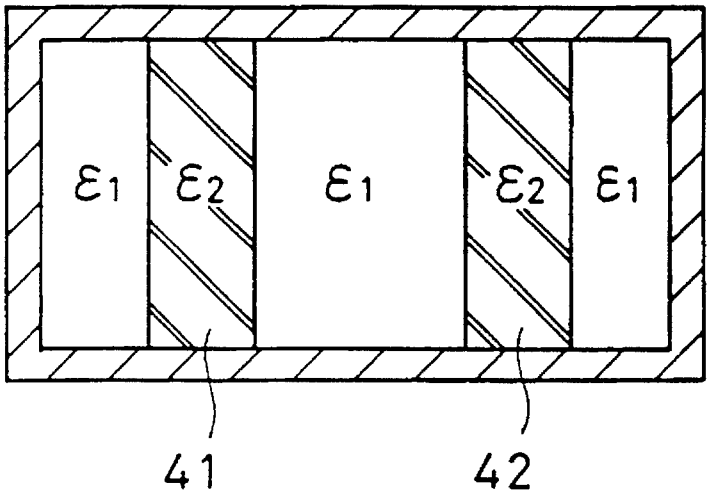

Similarly, the characteristics of the waveguide tube can be varied by providing two dielectric bodies 41 and 42 respectively contacting with the opposing two out of four internal peripheral surfaces of the rectangular waveguide tube, as shown in FIG. 10B.

It should be appreciated that, in the constructions illustrated in FIGS. 8A, 8B, 9A, 9B, 10A, 10B, the dielectric constant in the waveguide tube is $\epsilon 1$ and the dielectric constant of the dielectric body is $\epsilon 2$.

As set forth above, according to the present invention, the mode conversion frequency is shifted to the lower frequency by providing the dielectric body within the flexible waveguide tube to permit use of the dielectric flexible waveguide tube at desired milliwave band. Also, since the desired frequency characteristics can be obtained with the waveguide tube having relatively large cross section, the strength of the waveguide tube can be maintained to be sufficiently high. In addition, the present invention makes it easy to process the bellows portion by permitting relatively large cross section of the waveguide tube. Furthermore, by providing the clearance between the dielectric body and the inner periphery of the bellows portion, the flexibility of the waveguide tube can be certainly maintained so that the waveguide tube can be efficiently installed in relatively small space within an equipment installation space.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above but to include all possible embodiments which can be encompassed within the scope and equivalents thereof with respect to the feature set out in the appended claims.

What is claimed is:

1. A flexible waveguide tube comprising: a flexible bellows portion having inner peripheral surfaces;

at least one dielectric body disposed within the waveguide tube, said dielectric body being placed in spaced apart relationship with at least one of said inner peripheral surfaces of said bellows portion;

wherein said waveguide tube has a rectangular cross section, said bellows portion having two oppositely disposed ends, respective rectangular tube portions are provided at both ends of said bellows portion, each said rectangular tube portion having a plurality of inner peripheral surfaces, and said dielectric body being in contact with two of said inner peripheral surfaces of said rectangular tube portion, said two inner peripheral surfaces in contact with said dielectric body being opposite each other.

2. A flexible waveguide tube as set forth in claim 1, wherein said dielectric body has a specific dielectric constant greater than or equal to 2.

3. A flexible waveguide tube as set forth in claim 1, wherein said dielectric body is poly tetra fluoro ethylene.

4. A flexible waveguide tube as set forth in claim 1, wherein said dielectric body being in polygonal cross section.

5. A flexible waveguide tube as set forth in claim 1, wherein said dielectric body is positioned in contact with said two inner peripheral surfaces of said rectangular tube portions along longitudinal axes of said two inner peripheral surfaces, said longitudinal axes extending in a direction of a wave propagating past said two inner peripheral surfaces.

6. A flexible waveguide tube comprising: a flexible bellows portion having inner peripheral surfaces;

at least one dielectric body disposed within the waveguide tube, said dielectric body being placed in spaced apart relationship with at least one of said inner peripheral surfaces of said bellows portion;

wherein said waveguide tube has a rectangular cross section, said bellows portion having two oppositely disposed ends, respective rectangular tube portions are provided at both ends of said bellows portion, each said rectangular tube portion having a plurality of inner peripheral surfaces, and said dielectric body being in contact with three of said inner peripheral surfaces of each said rectangular tube portion.

7. A flexible waveguide tube as set forth in claim 6, wherein two of said three inner peripheral surfaces of each said rectangular tube portion in contact with said dielectric body being opposite to each other, said dielectric body is positioned to contact said two inner peripheral surfaces along longitudinal axes of said two inner peripheral surfaces, said longitudinal axes extending in a direction of a wave propagating past said two inner peripheral surfaces.

8. A flexible waveguide tube comprising: a flexible bellows portion having inner peripheral surfaces;

at least one dielectric body disposed within the waveguide tube, said dielectric body being placed in spaced apart relationship with at least one of said inner peripheral surfaces of said bellows portion;

wherein said waveguide tube has a rectangular cross section, said bellows portion having two oppositely disposed ends, respective rectangular tube portions are provided at both ends of said bellows portion, each said rectangular tube portion having a plurality of inner peripheral surfaces, and said dielectric body includes a first dielectric body being in contact with two of said inner peripheral surfaces of each said rectangular tube portion, and a second dielectric body being in contact with three of said inner peripheral surfaces of each said rectangular tube portion.

9. A flexible waveguide tube comprising: a flexible bellows portion having inner peripheral surfaces;

at least one dielectric body disposed within the waveguide tube, said dielectric body being placed in spaced apart relationship with at least one of said inner peripheral surfaces of said bellows portion;

wherein said waveguide tube has a rectangular cross section, said bellows portion having two oppositely disposed ends, respective rectangular tube portions are provided at both ends of said bellows portion, each said rectangular tube portion having a plurality of inner peripheral surfaces, and said dielectric body includes first and second dielectric bodies being in contact with two of said inner peripheral surfaces of said rectangular tube portions, said two contacted inner peripheral surfaces being opposite to each other.

10. A flexible waveguide tube comprising: a flexible bellows portion having inner peripheral surfaces;

at least one dielectric body disposed within the waveguide tube, said dielectric body being placed in spaced apart relationship with at least one of said inner peripheral surfaces of said bellows portion;

wherein said dielectric body is in a rectangular configuration.

11. A flexible waveguide tube comprising: a flexible bellows portion having inner peripheral surfaces;

at least one dielectric body disposed within the waveguide tube, said dielectric body being placed in spaced apart relationship with at least one of said inner peripheral surfaces of said bellows portion;

wherein said dielectric body is in a cylindrical configuration.

12. A flexible waveguide tube comprising: a flexible bellows portion having inner peripheral surfaces;.

at least one dielectric body disposed within the waveguide tube, said dielectric body being placed in spaced apart relationship with at least one of said inner peripheral surfaces of said bellows portion;

wherein said dielectric body is maintained in spaced apart relationship with all of said inner peripheral surfaces by dielectric body supports.

13. A flexible waveguide tube as set forth in claim 12, wherein said bellows portion has two oppositely disposed ends, with respective rectangular tube portions provided at both ends of said bellows portion, and said dielectric body supports being disposed in said rectangular tube portions.

14. A flexible waveguide tube comprising: a flexible bellows portion having inner peripheral surfaces;

at least one dielectric body disposed within the waveguide tube, said dielectric body being placed in spaced apart relationship with at least one of said inner peripheral surfaces of said bellows portion;

wherein said dielectric body is in spaced apart relationship with all of said inner peripheral surfaces of said bellows portion.

* * * * *